United States Patent [19]

Vezzani

[11] Patent Number: 4,552,062

[45] Date of Patent: Nov. 12, 1985

[54] SCRAP METAL PRESS FOR PRODUCING COMPACTED SCRAP BLOCKS

[75] Inventor: Luciano Vezzani, Ovada, Italy

[73] Assignee: Officine Vezzani S.p.A., Milan, Italy

[21] Appl. No.: 520,671

[22] Filed: Aug. 5, 1983

[30] Foreign Application Priority Data

Sep. 27, 1982 [IT] Italy ..... 23450 A/82

[51] Int. Cl.[4] ..... B30B 9/32

[52] U.S. Cl. ..... 100/95; 83/923; 100/98 R; 100/215; 222/199

[58] Field of Search ..... 100/39, 98 R, 215, 95; 83/923; 414/525 A; 198/750, 766; 193/2 B; 222/196.5, 199, 200

[56] References Cited

U.S. PATENT DOCUMENTS

| | | | |
|---|---|---|---|
| 878,847 | 2/1908 | Williams | 222/199 |
| 2,907,498 | 10/1959 | Van der Lely | 222/200 X |
| 3,892,337 | 7/1975 | Neumann | 222/199 |
| 4,253,388 | 3/1981 | Vezzani | 100/98 R |

FOREIGN PATENT DOCUMENTS 518430 10/1972 U.S.S.R. .

*Primary Examiner*—Billy J. Wilhite

*Attorney, Agent, or Firm*—Guido Modiano; Albert Josif

[57] ABSTRACT

A scrap metal press is disclosed which includes an inclined feeder box, downstream whereof there are provided at least one compacting unit and a guillotine shears unit for the production of compacted scrap blocks. To ensure that a smooth downward movement of the scrap metal can occur even with the feeder box only slightly inclined on a horizontal plane, a plate is provided at the box bottom which is at least temporarily reciprocated with a component in the same direction as the box longitudinal direction. The plate motion, which brings about a condition of dynamic friction between the scrap metal and plate, is preferably accomplished by the use of a slow-motion hydraulic motor having an off-centered pivot pin passed through an opening in the box bottom and engaging pivotally with a body attached to the plate and being loosely movable within the opening.

4 Claims, 7 Drawing Figures

SCRAP METAL PRESS FOR PRODUCING COMPACTED SCRAP BLOCKS

BACKGROUND OF THE INVENTION

This invention relates to a scrap metal press for producing compacted scrap blocks. More in detail the invention relates to a press of the type having an inclined feeder box.

With a press of this type, as disclosed in U.S. Pat. No. 4,253,388 to the same Applicant, the loose scrap metal, which is loaded through the top portion of the box, slides progressively toward the lowermost portion by gravity, where it is compacted at least in one direction transverse to the feeding direction and then sheared by means of guillotine shears located downstream of the compacting unit. The sheared block of compacted material is allowed to drop out of the press for removal.

A press of that kind affords a virtually continuous processing cycle because the material, owing to the inclination of the feeder box, moves constantly toward the compacting and shearing areas. Accordingly, the output rate of such a press can be quite high compared with other conventional presses which feature a discontinuous mode of operation owing to the material to be processed being loaded and fed discontinuously.

However, the tilted attitude of the press has the disadvantage that the scrap metal loading level has to be quite high, while a specially strong supporting structure is required to provide support for the massive inclined parts of the press.

In some cases, e.g. with certain types of heavy materials such as rails, large sectional members, etc., the scrap metal may come down with too much violence and cause those parts which are to take the impact to wear out quickly.

Such drawbacks could be attenuated by reducing the inclination of the feeder box on the horizontal, but this is only feasible up to a point, because too low an angle may make the scrap metal advancing movement uncertain or even non-existent, thus jeopardizing all the advantages of a continuous feed by gravity.

Such an approach, however, would have the disadvantage of subjecting the whole transporting structure to vibration. In addition to its prohibitive cost, this embodiment would not be readily applicable where shears equipment is provided. Further, power requirements would also be high, and the press as a whole would be excessively noisy.

SUMMARY OF THE INVENTION

It is an object of this invention to provide a press as specified above, which while retaining all the advantages of prior presses can obviate their shortcomings. In particular, the invention is directed to provide a press which has a feeder box set at a greatly reduced inclination angle over prior presses, even at a smaller angle than the minimum angle which ensures unforced advancement of the scrap metal, but wherein a correct feed can be ensured in all cases through very simple means and a moderate labor consumption, without resorting to the use of vibrating chutes or boxes.

This and other objects, such as will be more clearly apparent from the description which follows, are achieved by a scrap metal press for producing compacted scrap blocks, comprising an inclined feeder box and, located at the lowermost portion of the feeder box, at least one compacting unit acting in a direction substantially transverse to the scrap metal advance direction, and a guillotine shears unit for separating the compacted scrap blocks, which press is characterized in that, at the bottom of the feeder box, there is provided a plate at least temporarily reciprocable at least in the longitudinal direction of said feeder box.

Advantageously, with a press of this type, the scrap metal placed in the feeder box, and hence, on the reciprocable plate, and which is to be advanced toward the compacting and shearing areas, is in a condition of dynamic friction with respect to the plate, which thing ensures that the scrap metal will move forward even at small inclination angles, since the dynamic frictional coefficient is at the most one half the frictional coefficient of initial separation which causes instead the material to move down into the inclined feeder box of conventional presses. Further the movement of the plate allows whether the advancing of the scrap in the box or a pre-compaction of the scrap at lowermost portion of the feeder box before that the scrap comes compacted by the compacting unit. Thus, an efficient press with a slightly inclined feeder box is provided with extremely simple means. Moreover, a simpler overall construction of the press is achieved, while the loading of scrap metal into the box is facilitated because the scrap metal need not be raised to any great height.

BRIEF DESCRIPTION OF THE DRAWINGS

Further features and advantages of the invention will be more clearly understood from the following detailed description of a preferred, though not limitative, embodiment of a press according to the invention, given herein by way of example only and being illustrated in the accompanying drawings, where.

DESCRIPTION OF THE PREFERRED EMBODIMENTS

Figure 1:
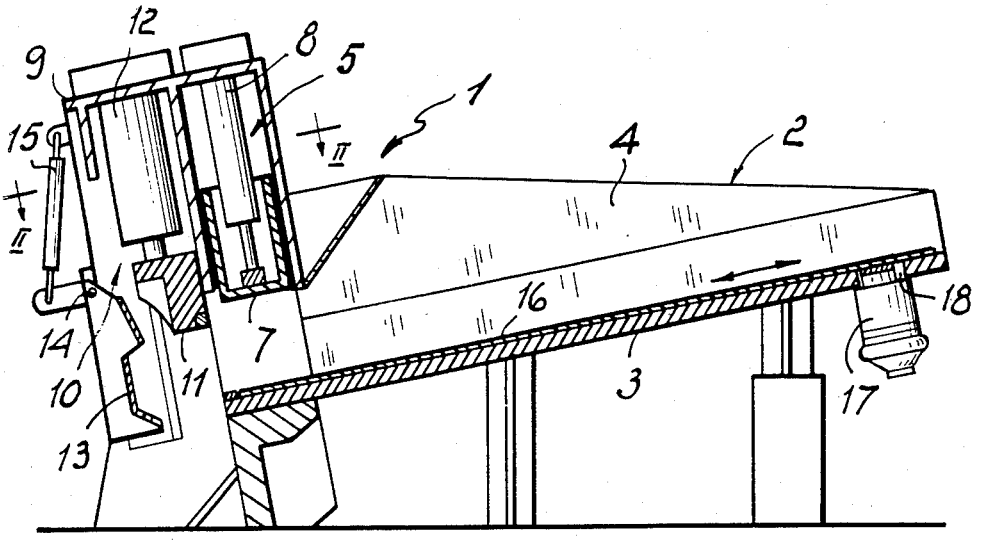
FIG. 1 is an axial vertical sectional view of a press according to the invention in the inoperative condition thereof.
Figure 2:
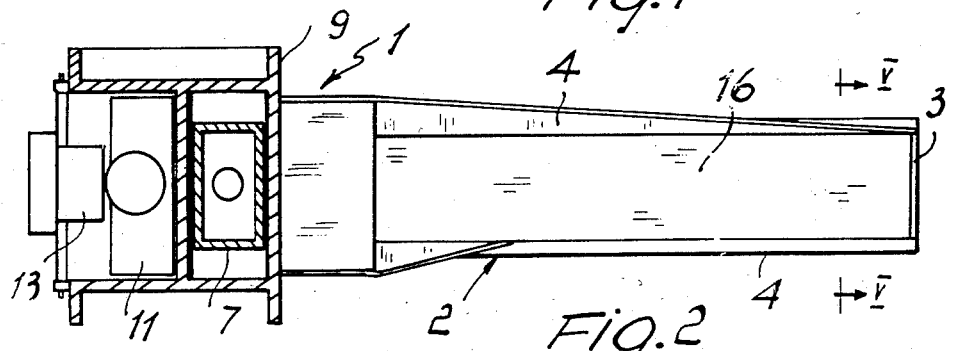
FIG. 2 is a top plan sectional view of the press as taken on the section plane II—II of FIG. 1.

Making reference to the accompanying drawings, a press 1 according to the invention comprises a feeder box 2 having an inclined bottom 3 and sidewalls 4 which advantageously diverge outwardly at least at the lowermost region of the box 2.

At said lowermost region of the box, there is arranged at least one compacting unit 5 which acts in a direction substantially perpendicular to the direction of advance of scrap metal 6 and to the bottom 3 of the box 2. This unit 5 includes a compacting ram 7 driven by a fluid dynamic cylinder 8 which is carried by the frame 9 of the press.

The arrangement and operation of this compacting unit 5 are known already from the cited U.S. Patent, and are no further discussed herein.

Located downstream of the compacting unit 5 is a guillotine shears unit 10 of a similar type to that illustrated in the cited U.S. Patent. In particular, the shears unit 10 comprises a shearing block 11 driven by a fluid dynamic cylinder 12 in a direction perpendicular to that of advance of the scrap metal 6 and parallel to the compacting direction. The fluid dynamic cylinder 12 is carried on the main frame 9 of the press in a manner known per se. The operation of this shears unit is also known from the cited U.S. Patent and no further described herein.

Figure 3:
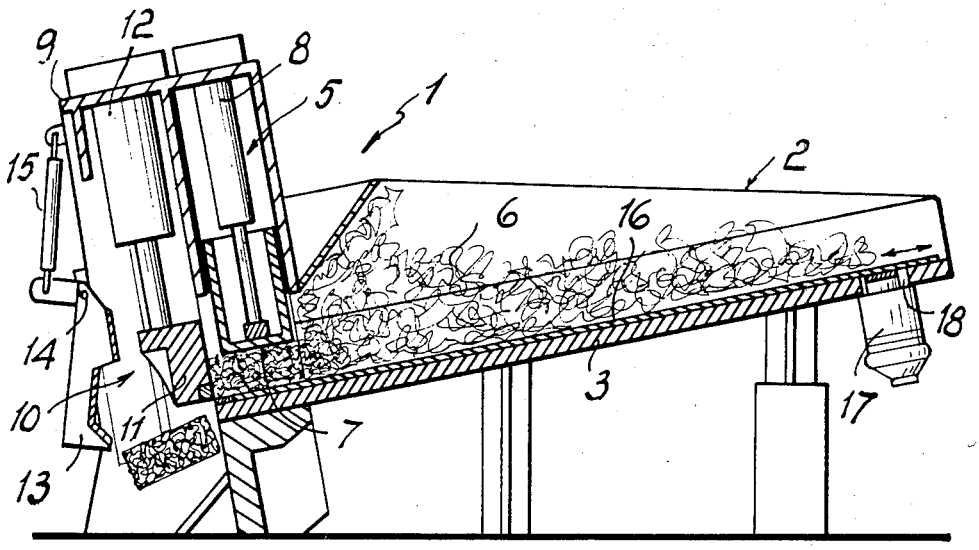
FIG. 3 is a sectional view similar to that of FIG. 1, but taken during the scrap metal compacting and shearing steps.
Figure 4:
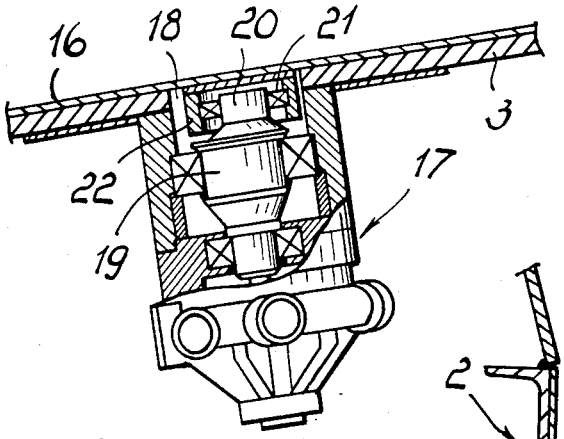
FIG. 4 is an enlarged scale view of the movable plate drive means.

Downstream of the shears unit 10, there is provided a stop member 13 journalled at 14 to the press frame 9 and being adapted to stop the forward movement of a compacted scrap block during the shearing step. A fluid dynamic cylinder 15, or other equivalent means, allows the stop member 13 to be brought into a suitable position for discharging the compacted scrap block, as shown in FIG. 3.

According to this invention, provided at the bottom of the feeder box 2 is a movable plate 16 which can be reciprocated at least temporarily back and forth at least in the longitudinal direction of the feeder box 2, that is, in the direction of advance of the scrap metal 6. The plate 16, advantageously formed from sheet metal, has a surface area which is substantially equal to, or slightly smaller than, that of the bottom 3 of the box 2.

Figure 5:
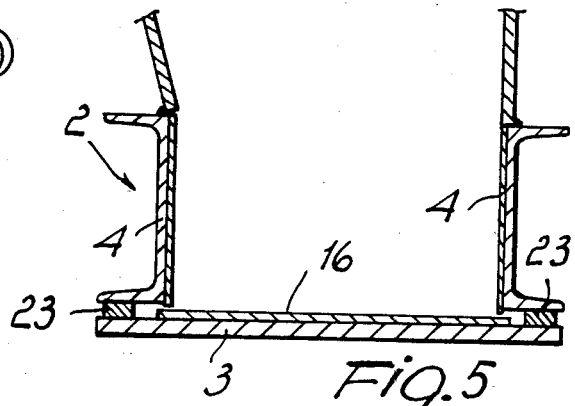
FIG. 5 is a cross-sectional view taken through the lower portion of the feeder box along the line V—V of FIG. 2.
Figure 6:
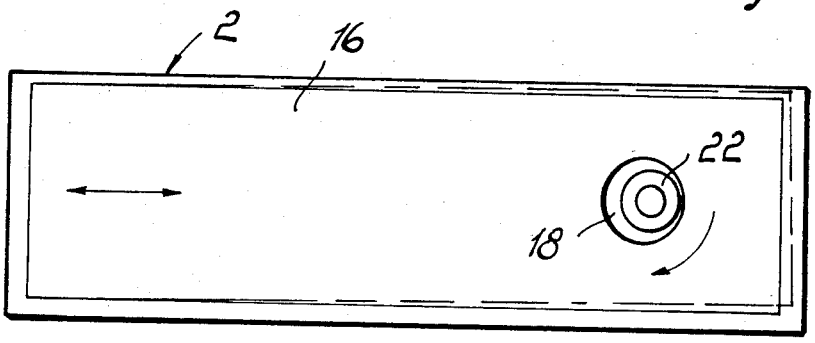
FIG. 6 is a simplified view of the feeder box bottom illustrating diagramatically the movement of the reciprocating plate.

For driving the plate 16, there is provided a hydraulic motor 17 of the slow moving type, which is carried by the feeder box 2 on the outside thereof and at an opening 18 through the bottom 3, which opening is formed preferably in the proximities of the topmost end of the box 2. The motor 17, of conventional design, has a shaft 19 provided at its free end with an off-centered pin 20 whose axis extends parallel to the shaft axis and perpendicular to the plate 16. Through the intermediary of bearings 21, the off-center pin 20 engages from the inside a hollow cylindrical body 22 which is accommodated with play within the opening 18 and fastened to the movable plate 16. It will be appreciated that a rotational movement of the shaft 19 results in an eccentric movement of the body 22, and accordingly, in a reciprocating movement of the plate 16 having a longitudinal and transverse component to the lay of the box 2. The transverse movement is enabled by the plate 16 being received with side play between longitudinal strips 23 which are secured between the sidewalls 4 and bottom 3 of the box 2, as shown in FIG. 5.

It should be noted that the reciprocating motion of the plate 16 below the scrap metal mass 6 avoids fixed contact between the plate and scrap metal, and hence, the need for overcoming a static friction therebetween, a dynamic contact being instead provided which greatly lowers the frictional coefficient, thereby a continuous forward movement of the scrap metal and a precompaction of it is ensured even for a very small inclination angle of the feeder box 2 with respect to the horizontal.

It is also noteworthy that a modest amplitude of the oscillation performed by the plate 16 is adequate, a small travel distance being sufficient to create the dynamic friction between the scrap metal 6 and plate 16. Actual tests have shown that optimum sliding conditions may be achieved already for inclination angles of 5°–10°. In particular, exceptionally good results have been achieved using inclination values as above and a motor rate of oscillation of 120 to 180 rpm (i.e. 2–3 Hz) and an amplitude of oscillation of 5–8 cm.

Figure 7:
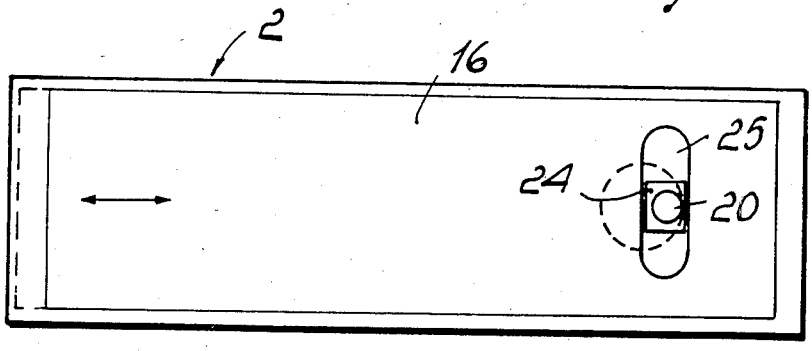
FIG. 7 is a view similar to that of FIG. 6, but showing a modified embodiment of the reciprocating plate and of the drive means therefor.

Since the oscillations of the plate 16 in a direction transverse to the feeder box 2 are not essential to the forward movement of the scrap metal 6, it becomes possible to provide a purely longitudinal movement of the plate 16, e.g. as shown in FIG. 7. In that case, a block 24, movable within a cross window 25 in the plate 16, is pivotally associated with the off-center pin 20. Thus, the transverse component of the movement of the pin 20 is not transmitted to the plate 16, and the latter moves in just the longitudinal direction, as indicated by the arrows of FIG. 7. Of course, the window 25 would be covered, or formed as a separate body attached under the plate 16, so as to prevent the entrance of scrap metal.

The plate 16 may obviously have a suitably treated surface, such as chromium plated, to reduce the frictional coefficient between the scrap metal and plate. The plate itself could also be actuated temporarily, i.e. stopped during the compacting and shearing steps. It will be apparent, moreover, that the feeder box 2 may be constructed as described in the cited UK Patent, and that a horizontal compacting unit, across the direction of advance of the scrap metal, may be provided as disclosed in said prior patent.

Many other modifications and changes may, of course, be applied to the invention without departing from the protection scope thereof. The inclination angle of the feeder box 2 may, of course, be varied within wide limits, even outside of the values given hereinabove by way of example.

I claim:

1. A scrap metal press for producing compacted scrap blocks comprising:

an inclined feed box having a lowermost end portion and an uppermost opposite end portion and defining a scrap metal advance direction pointing from said uppersmost opposite and portion towards said lowermost end portion;

said inclined feed box having a fixed supporting bottom;

at least one compacting unit located at the lowermost portion of said feed box;

said compacting unit acting in a direction substantially transverse to the scrap metal advance direction;

a guillotine shears unit for separating the compacted scrap blocks; and a plate resting on said bottom in slidable relationship therewith, means for at least temporarily reciprocating said plate at least in the scrap metal advance direction of said feeder box, said means comprising a rotable off-center pin having a rotation axis perpendicular to said bottom and said plate and rotably engaging said plate.

2. A press according to claim 1, further comprising a slow-motion hydraulic motor having a housing secured to said bottom outside thereof adjacent an opening of said bottom, said motor driving said pin and said pin rotatably engaging a body secured to said plate and movable with play within said opening.

3. A press according to claim 2, wherein said motor is arranged at a top end of said bottom of said feeder box.

4. A press according to claim 1, further comprising a transverse window in said plate and a block arranged to be slidable in said transverse window, said block being reciprocated in said transverse window by said off-center pin.

* * * * *